US008217342B2

(12) United States Patent
Vidal-De-Miguel

(10) Patent No.: US 8,217,342 B2
(45) Date of Patent: Jul. 10, 2012

(54) IONIZER FOR VAPOR ANALYSIS DECOUPLING THE IONIZATION REGION FROM THE ANALYZER

(75) Inventor: Guillermo Vidal-De-Miguel, Madrid (ES)

(73) Assignee: Sociedad Europea de Analisis Diferencial de Movilidad (ES)

( * ) Notice: Subject to any disclaimer, the term of this patent is extended or adjusted under 35 U.S.C. 154(b) by 69 days.

(21) Appl. No.: 12/686,669

(22) Filed: Jan. 13, 2010

(65) Prior Publication Data

US 2010/0176290 A1 Jul. 15, 2010

Related U.S. Application Data

(60) Provisional application No. 61/204,996, filed on Jan. 14, 2009.

(51) Int. Cl.

| | |
|---|---|
| ***H01J 27/20*** | (2006.01) |
| ***H01J 49/26*** | (2006.01) |
| ***H01J 49/10*** | (2006.01) |
| ***H01T 19/00*** | (2006.01) |

(52) U.S. Cl. ..... 250/288; 250/281; 250/282

(58) Field of Classification Search ..... 250/281, 250/282, 288

See application file for complete search history.

(56) References Cited

U.S. PATENT DOCUMENTS

| | | | | |
|---|---|---|---|---|
| 6,784,422 | B2 * | 8/2004 | Covey et al. | 250/288 |
| 7,279,680 | B2 * | 10/2007 | Miller et al. | 250/288 |
| 7,498,570 | B2 * | 3/2009 | Boyle et al. | 250/286 |
| 7,816,646 | B1 * | 10/2010 | Willoughby et al. | 250/288 |
| 7,919,746 | B2 * | 4/2011 | Whitehouse et al. | 250/288 |
| 2008/0251714 | A1 * | 10/2008 | Juan et al. | 250/288 |
| 2011/0006198 | A1 * | 1/2011 | Whitehouse et al. | 250/282 |

* cited by examiner

*Primary Examiner* — Jack Berman
*Assistant Examiner* — Wyatt Stoffa
(74) *Attorney, Agent, or Firm* — Hoffmann & Baron, LLP

(57) ABSTRACT

A method and apparatus are described to increase the efficiency with which a sample vapor is ionized prior to being introduced into an analyzer. Excellent contact between the vapor and the charging agent is achieved in the ionization chamber by separating it from the analyzer by means of a perforated impaction plate. As a result, some desired fraction of the gas going into the analyzer or coming out of the analyzer can be controlled independently from the flow of sample through the ionization chamber. Furthermore, penetration into said ionization chamber of said desired fraction of the gas going into or out of the analyzer is minimized by controlling the dimensions of said perforated impaction plate. Ions formed in the ionization chamber are driven partly by electric fields through said hole in said perforated impaction plate into the inlet to the analyzer. As a result, most of the gas sampled into the analyzer carries ionized vapors, even when the sample flow of vapor is very small, and even when the analyzer uses counterflow gas.

17 Claims, 8 Drawing Sheets

FIG 1. "Prior Art."

FIG 2. "Prior Art."

IONIZER FOR VAPOR ANALYSIS DECOUPLING THE IONIZATION REGION FROM THE ANALYZER

CROSS REFERENCE TO RELATED APPLICATION

This application claims the benefit of priority to U.S. Provisional Patent Application No. 61/204,996, filed Jan. 14, 2009, the entire contents of which is incorporated by reference herein.

U.S. PATENTS AND APPLICATIONS CITED

U.S. Pat. No. 4,300,044; Iribarne; Julio V., Thomson; Bruce A, Method and apparatus for the analysis of chemical compounds in aqueous solution by mass spectroscopy of evaporating ions, Filed: May 7, 1980.

U.S. Pat. No. 4,531,056; Michael J. Labowsky, John B. Fenn, Masamichi Yamashita; Method and apparatus for the mass spectrometric analysis of solutions; Apr. 20, 1983.

U.S. Pat. No. 4,963,736; Donald J. Douglas, John B. French; Mass spectrometer and method and improved ion transmission; Nov. 15, 1989.

U.S. Pat. No. 6,107,628; Keqi Tang, Mikhail B. Belov, Aleksey V. Tolmachev, Harold R. Udseth, Richard D. Smith; Multi-source ion funnel; Mar. 25, 2003.

U.S. patent application Ser. No. 11/732,770; Martinez-Lozano P., Fernandez de la Mora J.; Method for detecting volatile species of high molecular weight; Apr. 4, 2006.

U.S. patent application Ser. No. 11/786/688; J. Rus, J. Fernandez de la Mora, Resolution improvement in the coupling of planar differential mobility analyzers with mass spectrometers or other analyzers and detectors. 11 Apr. 2007. Publication 20080251714, October 2008; PCT/EP2008/053762, publication WO2008/125463.

U.S. Patent Provisional application 61/131,878; Vidal G., Fernandez de la Mora J.; Method and apparatus to sharply focus aerosol particles at high flow rates and over a wide range of sizes; 13 Jun. 2008.

OTHER PATENTS AND APPLICATIONS CITED

Patent application PCT/EP2008/053960; Fernandez de la Mora J.; The use ion guides with electrodes of small dimensions to concentrate small charged species in a gas at relatively high pressure; 2 Apr. 2008.

OTHER DOCUMENTS CITED

[1] Cheng, W-H and Lee, W-J, Technology Development in Breath Microanalysis for Clinical Diagnosis. J. Lab. Clin. Med. 133, 218-228 (1999).

[2] Lane, D. A.; Thomson, B. A. Monitoring a chlorine spill from a train derailment. *J. Air Pollution Control Assoc.* 1981, 31 (2), 122-127.

[3] Fenn J B, Mann M, Mengu C K, Wong S F, Whitehouse C M, Electrospray ionization for mass-spectrometry of large biomolecules. Science 246 (4926): 64-71, 1989.

[4] Whitehouse, C. M., Levin, F., Meng, C. K. and Fenn, J. B., Proc. 34th ASMS Conf. on Mass Spectrom. and Allied Topics, Denver, 1986, p. 507.

[5] Fuerstenau, S., Kiselev, P. and Fenn, J. B., ESIMS in the Analysis of Trace Species in Gases. Proceedings of the 47th ASMS Conference on Mass Spectrometry (1999) Dallas Tex.

[6] Fuerstenau, S., Aggregation and Fragmentation in an Electrospray Ion Source. Ph.D. Thesis, Department of Mechanical Engineering, Yale University, 1994.

[7] Wu, C., Siems, W. F. and Hill, H. H. Jr., Secondary Electrospray Ionization Ion Mobility Spectrometry/Mass Spectrometry of Illicit Drugs. Anal. Chem. 2000, 72, 396-403).

[8] P. Martinez-Lozano, J. Rus, G. Fernández de la Mora, M. Hernández, J. Fernández de la Mora, Detection of explosive vapors below part per trillion concentrations with Electrospray charging and atmospheric pressure ionization mass spectrometry (API-MS). J. Am. Soc. Mass Spectr. doi:10.1016/j.jasms.2008.10.006.

[9] Lindinger, W., Hansel, A., Jordan, A., On-line monitoring of volatile organic compounds at pptv level by means of Proton-Transfer-Reaction Mass Spectrometry (PTR-MS). Medical applications, food control and environmental research. *International Journal of Mass Spectrometry and Ion Processes.* 173 (1998) 191-241.

[10] Amann, A. et al., Applications of breath gas analysis. *International Journal of Mass Spectrometry* 239 (2004) 227-233.

[11] Iribarne J V, Thomson B A. 1976. On the evaporation of small ions from charged droplets. *J. Chem. Phys.* 64:2287-94.

[12] P. Martinez-Lozano and J. Fernandez de la Mora, Detection of fatty acid vapors in human breath by atmospheric pressure ionization mass spectrometry, Analytical Chemistry, 2008, 80, 8210-8215.

[13] The effect of charge emissions from electrified liquid cones, J. Fluid Mechanics, 243, 561-574, April 1992.

FIELD OF THE INVENTION

The invention relates to the ionization of vapors present in a gas at very small concentrations for their chemical analysis. A substantial improvement in ionization efficiency is achieved by (i) approaching the equilibrium concentration of the ionized vapor, controlled by ionization kinetics and space charge dilution. (ii) Also by extracting the ionized vapors from the charger primarily by an electric field rather than through the gas flow. (iii) An additional improvement follows from introducing a perforated plate separating the ionization chamber from the region where the ionized vapor is drawn into an analytical instrument. This second feature is particularly advantageous in analyzers using counterflow gas. Those improvements are especially useful when the sample is limited, and when the flow rate of gas carrying sample vapor is smaller than that sampled into the analyzer.

BACKGROUND OF THE INVENTION

The analysis of species existing in a gas by virtue of their finite volatility is of interest in many situations, for instance, for detecting explosives or dangerous substances, in the food and aroma industries, in the identification of incipient symptoms of decomposition in foods, in medical diagnosis based on the composition of bodily fluids or breath, skin odors, etc. Because the species to be detected is in the gas phase, the dominant technique of such analyses has been gas chromatography coupled to mass spectrometry (GC-MS) [1]. However, the method is much slower and often less sensitive than the alternative of ionizing the vapors directly at atmospheric pressure and then introducing the resulting ions into a mass spectrometer with an atmospheric pressure source (API-MS). This approach was pioneered by the TAGA system developed at Sciex [2], where vapor ionization was achieved by means of an electrical discharge. A significant advance towards the development of detectors for trace gases was taken in U.S. Pat. No. 4,531,056 by J. Fenn and colleagues through their invention of so called electrospray mass spectrometry (ES-MS; see also reference [3]). This approach was not originally intended to apply to gases. However, Fenn and colleagues [4, 5, 6] noted that vapors put in contact with an electrospray cloud were efficiently ionized, with limits of detection in the parts per billion level (ppb=$10^{-9}$ atmospheres of partial pressure). Earlier studies had already demonstrated excellent though inferior sensitivities for vapors based on ionizing them at atmospheric pressure and then analyzing them in instruments referred to as ion mobility spectrometers (IMS). In this case the ionization sources had been generally based on radioactive materials, such as Ni-63. But Wu et al. [7] had also obtained interesting results with an electrospray charger which they referred to as secondary electrospray ionization (SESI), which is, broadly speaking, analogous to that independently described by Fenn and colleagues (for an MS rather than an IMS analyzer). The relative merits of the corona discharge used in the TAGA instrument and the SESI charger have remained unstudied for a long time, probably for the same reasons that led to the interruption of the use of API-MS systems for volatile analysis. The status of this long dormant field has been recently reviewed in [8].

Other specialized schemes have been developed independently for volatile analysis involving alternative methods of charging vapors. One example is so-called proton transfer reactions (PTR), where the vapors are mixed with solvated protons in a fast flow at reduced pressure. Part per trillion (ppt=$10^{-12}$ atmospheres of partial pressure) lowest detection limits have been reported, though only with vapors of relatively small molecular weight [9, 10].

Because the potential of API-MS analysis of volatiles is more easily achieved based on commercial API-MS instruments rather than specialized research instruments, we shall focus the subsequent discussion of prior art on the former type. The charging and sampling methods taught by Fenn and colleagues require some detail that will provide the background for later improvements. The electrospray mass spectrometry method they had introduced in U.S. Pat. No. 4,531,056 involves the use of a counterflow dry gas interposed between the atmospheric pressure inlet of the mass spectrometer and the electrospray source. Some typical elements of this system are shown in FIG. 1, together with other new features to be later discussed. The MS inlet (1) is most often a small orifice in a plate or the bore of a capillary, through which atmospheric gas is sampled at sonic speed into the vacuum system of the mass spectrometer (2). For the purpose of the present invention the analyzer is not necessarily a mass spectrometer, but could be similarly an IMS or a DMA. The counterflow gas, often nitrogen, bathes the region upstream of the sonic orifice (1), enclosed in a chamber open towards the atmosphere through a curtain plate orifice (3). Part of the counterflow gas is sampled into the vacuum system of the MS (2) through the orifice (1), forming a supersonic jet (4). The rest exits through the curtain plate orifice (3), forming a counterflow or curtain jet (5), initially coaxial with the sonic jet, but moving in the opposite direction towards the open atmosphere of the room. This counterflow gas is meant to avoid ingestion by the MS of condensable vapors or dust coming from either the electrospray drops or the surrounding atmosphere. Ions, however, are able to penetrate through the curtain gas, driven by electric fields against the counterflow. A similar approach in which the term curtain gas was first coined had been used in Sciex instruments prior to Fenn's work, with a different type of atmospheric pressure ionization source. Its origin can be traced back to U.S. Pat. No. 4,300,044 and the pioneering work if Iribarne and Thomson [11]. The counterflow gas used by Fenn and colleagues impinged frontally against the electrospray cloud (6), offering excellent contacting area between the dry gas and the charged drops and electrospray ions. This useful feature was used in [4, 5] for volatile charging to increase the vapor ionization probability by feeding controlled quantities of vapor mixed with the counterflow gas, thereby maximizing their contact with the charged cloud and hence the charging probability of the vapor species. Under these conditions they could report sensitivities "for some species at ppb levels or less" [5]. Although quite novel at the time, such sensitivities are unfortunately inadequate to detect explosives such as PETN or RDX. Another problem with this approach when used for the analysis of ambient species is that the sample ambient gas is generally not clean, whereby the mass spectrometer would be rapidly contaminated. Furthermore, condensation of ambient water vapor on the ions would seriously impair the operation of the MS (though this difficulty may be overcome in some cases by substantial heating of the sampled humid gas). One solution to sidestep this contamination problem is proposed in U.S. patent application Ser. No. 11/732,770 by Martinez-Lozano and Fernandez de la Mora, where the contaminated flow carrying the sample is fed into a chamber in which clean counterflow gas coming from the curtain plate orifice (3) flows directly against an electrospray cloud. This system contributes various improvements over prior art taught in [4, 5], whose combination has enabled record lowest detection levels as small as 0.2 ppt for trace vapor species [8], while also moderating the ingestion of dust, water vapor and other contaminants into the mass spectrometer. The setup of U.S. Ser. No. 11/732,770 is shown schematically in FIG. 2. Briefly, the vapors to be analyzed are ionized by contact with a source of charge, they are then drawn into a mass spectrometer in a fashion such that contaminant ingestion is greatly reduced. Finally, the transmission of ions into the analyzing section of the mass spectrometer is much enhanced by the use of so-called ion guides, as discussed for instance in U.S. Pat. No. 4,963,736, or in the related ion funnels of U.S. Pat. No. 6,107,628. Instead of carrying the vapors of interest to be analyzed (subsequently referred to as target vapors) with the counterflow, Martinez-Lozano and Fernandez de la Mora carry said vapors with another flow to be referred to as sample flow (7). In one single chamber (8), directly connected to the curtain plate of the mass spectrometer, they introduce the sample flow (7) laterally, while the ionization source (9) and the counterflow jet (5) are aligned along the same axis. In the preferred embodiment of U.S. Ser. No. 11/732,770, the ionization source is an ES source that produces the electrospray cloud (6).

Counterflow gas and dilution of the sample vapor in the ionization volume. In the publications making use of the charger of U.S. Ser. No. 11/732,770, the sample flow used was typically 6 lit/min, while the flow taken by the analyzer was only 0.5 lit/min [12, 8]. Although large with respect to the analyzer intake flow, these sample flow rates are in fact considerably smaller than those typical in the earlier TAGA system. But they are still relatively large for many applications.

In order to facilitate ionization of the sample and the ingestion of the resulting sample ions into the analyzer, the sample gas and the ionizing agents produced by the ionization source (9) must coexist in a volume where the streamlines formed by the velocity of the ions reach the entrance of the analyzer. This volume will be termed here the effective ionization volume. In the configuration of FIG. 2, where the ion source and the curtain plate orifice (3) are approximately coaxial, the ionization volume tends to be substantially occupied by clean counterflow gas. In order for the sample gas to be ionized, it must reach the effective ionization volume. This it can do either weakly by diffusion across the counterflow jet, or more vigorously by having sufficient momentum to deflect the counterflow jet (5) away from part of the effective ionization volume (as shown in FIG. 2). In this configuration, the ionization source (9) must be maintained at a certain distance from the curtain plate orifice (3), such that the counterflow jet (5) is sufficiently weakened to be deflected. The unbounded lateral impaction between the counterflow jet and the sample flow is typically unstable and leads to effective mixing between both flows. As a result, the vapors in the effective ionization volume are diluted by the counterflow.

The reasons why these substantial sample flows were previously needed to achieve good sensitivity have not been discussed in the published or patent literature. However, the sample flow rate clearly needs to be higher or at least of the same order as the counterflow to counteract dilution by the counterflow, and to partially deflect the counterflow jet away from the ionization volume. This notion can be expressed in terms of the dimensionless parameter to be referred to as the flow ratio q, defined as the ratio between the sample flow rate and the counterflow flow rate. Therefore, in the ionizer of U.S. Ser. No. 11/732,770, the flow ratio q has in principle to be of order unity or larger, and it is found in practice that it needs to be substantially larger. Under such conditions prior work [12] has achieved record high sensitivities, though at the cost (not always affordable) of consuming considerable sample flow.

The case of limited available sample. The need for relatively large q values in U.S. Ser. No. 11/732,770 does not appear to pose great problem, as long as the volume of gas to be analyzed is not substantially limited, such as when one samples from the open atmosphere or from a large room. However, in some applications, including explosive detection and skin vapor analysis, the rate at which the target species is incorporated into the gas sampled into the analyzer is limited. The total amount of the target species in the gas phase can also be limited if, for instance, it is desorbed from a collection or preconcentration device where target particles or vapors have been previously accumulated for a certain time period. In those cases, the concentration of vapors is inversely proportional to the sample flow rate and the scheme proposed by Martinez-Lozano is not able to efficiently use the limited available stock of sample. Having a high sample flow rate would inevitably dilute the sample with clean air before introducing it into the ionization chamber. And, if one tried to reduce the sample flow to avoid dilution at the source, the sample would still be highly diluted by the counterflow gas from the analyzer, while the region of coexistence between the target vapor and the ionization source would become small or could even disappear as the counterflow jet would occupy most of the effective ionization volume. Either using low sample flow rates or high flow rates therefore leads to high inefficiency.

The ionization probability and the target ion concentration. The behavior in the sample ionization region is peculiar when the ionization source is an electrospray or another ionization source producing preferentially ions of a single polarity. In this case, the rate at which vapor ionization takes place is proportional to the concentration $n_v$ of target vapors, the concentration $n_b$ of charger ions (to be so referred even though, as suggested by Fenn and colleagues, the charging agents may be electrospray drops), and a constant k governing the kinetics of the charge transfer reaction according to $$\frac{Dn_i}{Dt} = kn_v n_b, \tag{1}$$

where $Dn_i/Dt$ is the production rate of target ions (ions per unit time and volume), and the concentrations $n_b$ and $n_v$ are expressed in units of molecules/volume. Provisionally, we presume that $n_v$ is undisturbed either by the counterflow and the ionization reaction itself, and will subsequently discuss how this can be achieved. The concentration of the charger ions is typically much higher than the concentration of target ions. As a result, the effect of target ions on the electric field can be neglected. On the other hand, the concentration of charge is proportional to the divergence of the electric field. Assuming stationary conditions, the net flow of target ions $q_i$ (ions/s) emanated from the ionization volume can be computed as the volume integral of the ionization rate through the effective ionization volume $$q_i = \iiint kn_v n_b dV = \iiint kn_v \frac{\varepsilon_0}{e} \nabla \cdot \bar{E} dV, \tag{2, a, b}$$

where we use Poisson's law, $\in_0$ is the permittivity of vacuum, e is the charge of an ion and E is the electric field.

Applying the Gauss theorem to the effective ionization volume and introducing the total velocity field composed by the electric velocity plus the fluid velocity, one can easily conclude that the net flow of target ions emanated from the ionization volume is equal to $kn_v \in_o / Z_i e$ (where $Z_i$ stands for the mobility of the target ions) times the flux of the electric and fluid velocities. Note that the second integral in (3), where $V_f$ stands for the fluid velocity field, vanishes in the common circumstance in which the flow configuration is incompressible.

$$q_i = \frac{kn_v \varepsilon_0}{Z_i e}\left[\iint (\bar{V}_f + Z_i \bar{E}) \cdot \bar{n} dA - \iint \bar{V}_f \cdot \bar{n} dA\right]. \tag{3}$$

On the other hand, the net flow of target ions emanating from the ionization volume is:

$$q_i = \iint n_i (\bar{V}_f + Z\bar{E}) \cdot \bar{n} dA, \tag{4}$$

Integrating both (3) and (4) through an infinitesimally thin stream tube, so that the concentration of ions can be considered constant along any section of the stream tube, the concentration of target ions in a section 1 compared to that of a section 2 is:

$$n_{i2} = n_v \frac{k\varepsilon_0}{Z_i e} \cdot \left(1 - \frac{q_1}{q_2}\right) + n_{i1} \frac{q_1}{q_2}, \tag{5}$$

where $q_1$ and $q_2$ stand for the infinitesimal flux of the velocity field through section 1 and 2 respectively. Note that $(\bar{V}_f + Z\bar{E}) \cdot \bar{n} = 0$ along the walls of the stream tube.

For the special case where the charger ions are created by means of an electrospray tip, the term $q_1/q_2$ tends to zero in the limit when the first section 1 of the stream tube is very close to the electrospray tip. Under these circumstances, the concentration of target ions is uniform and does not depend on the electrical or fluid configuration in the sample ionization region, but is simply given by $$n_i = n_v \frac{k\varepsilon_0}{Z_i e}, \tag{6}$$

This result was previously obtained by J. Fernandez de la Mora (Yale) for the case when the fluid velocity can be neglected compared with the electric velocity.

The case of an electrospray source is very specific because it has a singularity. In a more general case where the ion concentration does not tend to infinity in any region, the final concentration of target ions will be given by equation (5) and will be always lower than the limit expressed in equation (6). Nevertheless, the term $q_1/q_2$ can be reduced by means of the space charge effect as long as the amount of charger ions is significant enough.

The probability of ionization p has been previously defined [8] as the ratio between the concentration $n_i$ of sample ions carried to the analyzer and the maximum concentration theoretically available, which is the concentration $n_v$ of target vapors. According to equation (6), this probability of ionization p is independent of the sample flow rate:

$$p = \frac{n_i}{n_v} = \frac{k\varepsilon_0}{Z_i e}. \tag{7}$$

The implications of this result are not altogether as good as one might hope from its elegant simplicity. The reason is that substitution of typical characteristic values for the various constants entering in equation (7) yield for atmospheric air: $p \sim 10^{-4}$. But because this dismally low value is independent of essentially all the variables under control, one is apparently led to the conclusion that, of every vapor molecule available, only a rather small fraction p can be ionized, whose minute value is beyond our control. These unpleasant apparent conclusions are in fact overoptimistic, as they ignore the dilution effects due to the counterflow gas, as well as additional dilution (to be later analyzed) taking place as the target ions penetrate through the counterflow jet on their way to the mass spectrometer inlet. These discouraging theoretical estimates for p agree reasonably with the approximate measurements reported in [8].

The fact that the final concentration $n_i$ of target ions achievable is independent of flow rate is somewhat puzzling, and it is useful for the purposes of this invention to understand why. The rate equation (1) indicates that $n_i \sim k n_v n_b t$, where t is a residence time. It follows that $n_i/n_v \sim k n_b t$, which would normally increase with the residence time, and would ordinarily increase as the flow rate is decreased. However, this is not the case in our problem for two reasons. First, the time available for ionization is not determined by the fluid velocity, but, primarily, by the swifter electric drift velocity. As long as there is no counterflow dilution and p is small, the vapor concentration is relatively constant and equal to its source value. Consequently $n_v$ is a passive actor and it makes little difference on the final $n_i$ whether the neutral vapor is moving or not. In other words, the residence time of the neutral vapor is much larger than that of the ions moved by the field, and is therefore relatively irrelevant in the determination of $n_i$. What really counts is the movement of the ions through the passive medium containing vapor molecules. Second, the concentration $n_b$ of charging ions is rapidly decreasing in time due to space charge. We shall subsequently see that, in the space charge controlled problem, the product $n_b t$ is in fact constant for an ion within the charged cloud, leading (in order of magnitude) to the same conclusion attained more rigorously in equation (6). This time can certainly be increased (by reducing the electric field or increasing the distance to be traveled from the tip of the ionizer to the analyzer). But then space charge decreases the concentration of charging ions, so that the effective $n_b t$ product is always the same. Space charge dilution is therefore the factor that limits p to the small and fixed values found when the charging ions are predominantly of only one polarity (unipolar ion source). This limitation has been previously recognized in PCT/EP2008/053960, where it was partially overcome by counteracting space charge repulsion with external radiofrequency fields.

In conclusion, prior attempts at ionizing vapors by interaction with charged drops and/or ions have encountered two kinds of limitations. First the serious dilution and expulsion effects of the target vapor away from the charging region in analyzers using counterflow gas. Second the tiny value of the maximum achievable charging probability resulting from the rapid space charge dilution of the charger ions. The first of these limitations is particularly harmful in circumstances when the sample available is limited.

Before proceeding to partially overcome these difficulties according to the present invention, it is instructive to introduce a charging probability more relevant than p in cases when the total quantity of sample gas available for analysis is limited. We define the single molecule probability of ionization $p_{mi}$ as the fraction of target gas molecules fed to the inlet of the ionizer that are transferred to the analyzer as ions. In the ideal case where counterflow dilution can be neglected, the probability of ionization and the single molecule probability of ionization are related as follows:

$$p_{mi} = p\frac{Q_A}{Q_s}, \tag{8}$$

where $Q_A$ is the flow rate of gas ingested by the analyzer; and $Q_S$ is the flow rate of sample gas. This result shows clearly that when $Q_A/Q_S >> 1$ one can apparently convert into ions a fraction of the neutral sample much larger than p. But how can this be done if $n_i/n_v$ is fixed independently of $Q_S$?

In the answer to this question lies the key to one central aspects of the present invention. The sample is used at a rate $Q_S n_v$. Yet, $n_i$ is fixed independently of $Q_S$. But the flux of target ions drawn into the analyzer is not necessarily $Q_S n_i$. It may in fact be much larger, as long as the electric drift velocity of these ions is much larger than typical flow velocities. In other words, space charge fixes the concentration of target ions, but not the flux at which they are extracted electrically. What one needs therefore to do is to increase this ion flux enough such that each parcel of gas sampled into the analyzer carries target ions at a concentration $n_i$ close to the value achievable in the charging chamber (in the absence of counterflow dilution). When $Q_S$ is small compared to $Q_A$, but not so small as to make $p_{mi}$ of order unity (say $p_{mi} < 0.1$), the consumption of vapor molecules is small, and those ionized and removed by the field can easily be replaced by diffusion from those outside the charged plume. $n_v$ will hence remain comparable to its source value. Then equation (6) holds, and application of a suitable electric field will extract an adequate flux of target ions to feed them to the analyzer at concentration approaching $n_i$. On the other hand, once $Q_A/Q_S$ is large enough to make $p_{mi}$ of order unity, neutral vapors will be consumed fast enough for $n_v$ to be reduced below its source value, modifying the previous results so that $p_{mi}$ would never exceed unity, but would simply tend towards it. It is therefore possible in principle to approach the ideal limit when the majority of the sample vapor molecules are ionized and transmitted to the analyzer. The present invention aims at progressing towards this possible ideal within practical limits. In reality, of course, one would only have a finite time available to perform the analysis, so that $Q_S$ would take a finite value. For example, suppose one wishes to analyze a sample of explosive molecules collected in a filter, where the volume of gas to be displaced from the filter into the analyzer is 5 $cm^3$. Suppose further that the analysis is to be completed in 10 minutes, so that the sample flow rate would be of 0.5 $cm^3$/min. If the flow rate into the analyzer is 0.5 lit/min, then $Q_A/Q_S=10^3$, whereby $p_{mi}$ would be 0.1 for $p=10^{-4}$. This would imply a use of sample some $10^4$ times more efficiently than in the work of [8] (where $Q_A/Q_S$~0.1), which showed in turn a considerably greater sensitivity for vapor detection than any preceding study.

As just noted, when the sample flow is small, the ions have to be drawn from the charging region into the analyzer primarily by the electric field. However, this has not been done properly in any prior study. In U.S. Ser. No. 11/732,770, the principal means used to push the ions through the counterflow region is the electric field generated by the electrospray tip, which decays relatively fast with the distance to the tip. Furthermore, this tip must be placed relatively far from the analyzer inlet to avoid the effect of dilution produced by the counterflow. In one instance where the ionizer described in [8] could not be fitted into a desired quadrupole mass spectrometer analyzer (Sciex's API 5000), the sample gas was directly opposed to the counterflow gas, and a relatively weak auxiliary field besides that created by the electrospray needle was used. Neither of these approaches, however, provides an adequate control of the electric field to feed the entrance region of the analyzer with target ions at a concentration near the ideal value given in equation (6). As a result, even if dilution is avoided by some as yet undisclosed scheme, either many streamlines reaching the analyzer will carry clean gas without target ions at low sample flow rates, or the sample will be used inefficiently at high sample flow rates. The present invention will incorporate means to apply the necessary fields to fill most streamlines entering the analyzer with ions at a concentration close to the ideal value of equation (6).

In conclusion, prior studies have succeeded at moderating the dilution associated to counterflow gas only at the cost of using high sample flow rates. In situations where the finite sample available must be used efficiently, whereby $Q_S/Q_A$ needs to be small, no solution has been available to either avoid sample dilution due to counterflow gas, or to drive the target ions efficiently into the analyzer inlet. Consequently, the purposes of the present invention are to teach (i) How to prevent dilution of neutral target vapors in the ionization region due to counterflow gas, and thus maximize the concentration of the sample flow in the ionization region;

(ii) How to fill with target ions the majority of the fluid streamlines sucked into the analyzer, and how to minimize the dilution of target ions due to diffusion and space charge effects as they cross a clean counterflow region.

(iii) How to reduce drastically the required sample flow, even in the presence of counterflow, and thus how to increase the single molecule probability of ionization while minimizing the dilution effects due to the counterflow.

(iv) How to reduce the flow of charger ions $q_b$ ingested by the analyzer without reducing the flow of target ions

SUMMARY OF THE INVENTION

This invention contributes a new more efficient way of ionizing vapor species for subsequent analysis in instruments, including those using counterflow gas. The approach is particularly advantageous in situations where the available vapor sample is limited. Dilution of target ions as they cross the counterflow region is reduced. Thus the sensitivity of the system 'ionizer plus analyzer' will be increased independently of whether the vapor sample is limited or not. Sample dilution and loss of useful ionization volume associated to the counterflow jet are virtually eliminated by performing the functions of the ionizer and the counterflow gas in two different chambers. The sample vapors first enter into an ionization chamber where they mix with the charging ions or drops, producing a certain concentration $n_i$ of ionized vapors near the exit of the chamber. The bottom of the ionization chamber communicates through an exit orifice with an impaction chamber located below it. A jet of sample flow leaves the ionization chamber through said exit orifice, and impacts frontally against the counterflow jet originating from the bottom of the impaction chamber. Penetration of the counterflow gas into the ionization chamber is averted by using a sufficiently small exit orifice. A flux of target ions sufficiently strong to fill most fluid streamlines sampled into the analyzer inlet is drawn from the ionization chamber (primarily by the electric field), with ionic speeds high enough to allow passage of the beam of target ions through the small exit hole in the ionization chamber. The target ion flux required to fill with ions most streamlines sucked into the analyzer is achieved by proper design of the electric field in the ionization and impaction chambers. Hence, this desired target ion flux is relatively independent of the sample flow rate which can be reduced to unusually low values, leading to unusually high single molecule probability of ionization. An uncommonly high conversion of vapor molecules into ions sucked into the analyzer is achieved by combining this high single molecule probability of ionization with a relatively high target ion concentration $n_i$ obtained by keeping the disruptive effects of the counterflow gas away from the ionization chamber.

MORE DETAILED DESCRIPTION OF THE INVENTION

Figure 1:
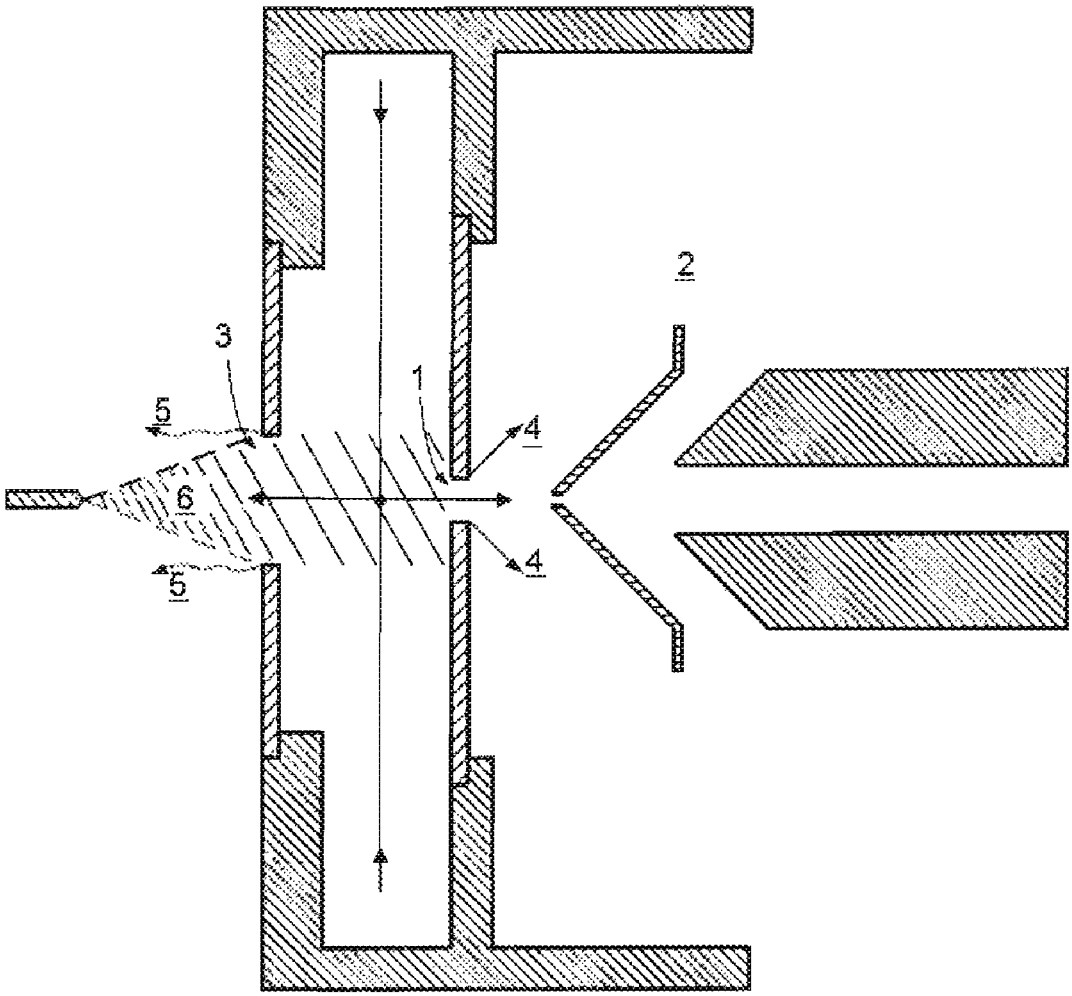
FIG. 1 illustrates schematically some of the elements in the fluid and electric configuration of U.S. Pat. No. 4,531,056.
Figure 2:
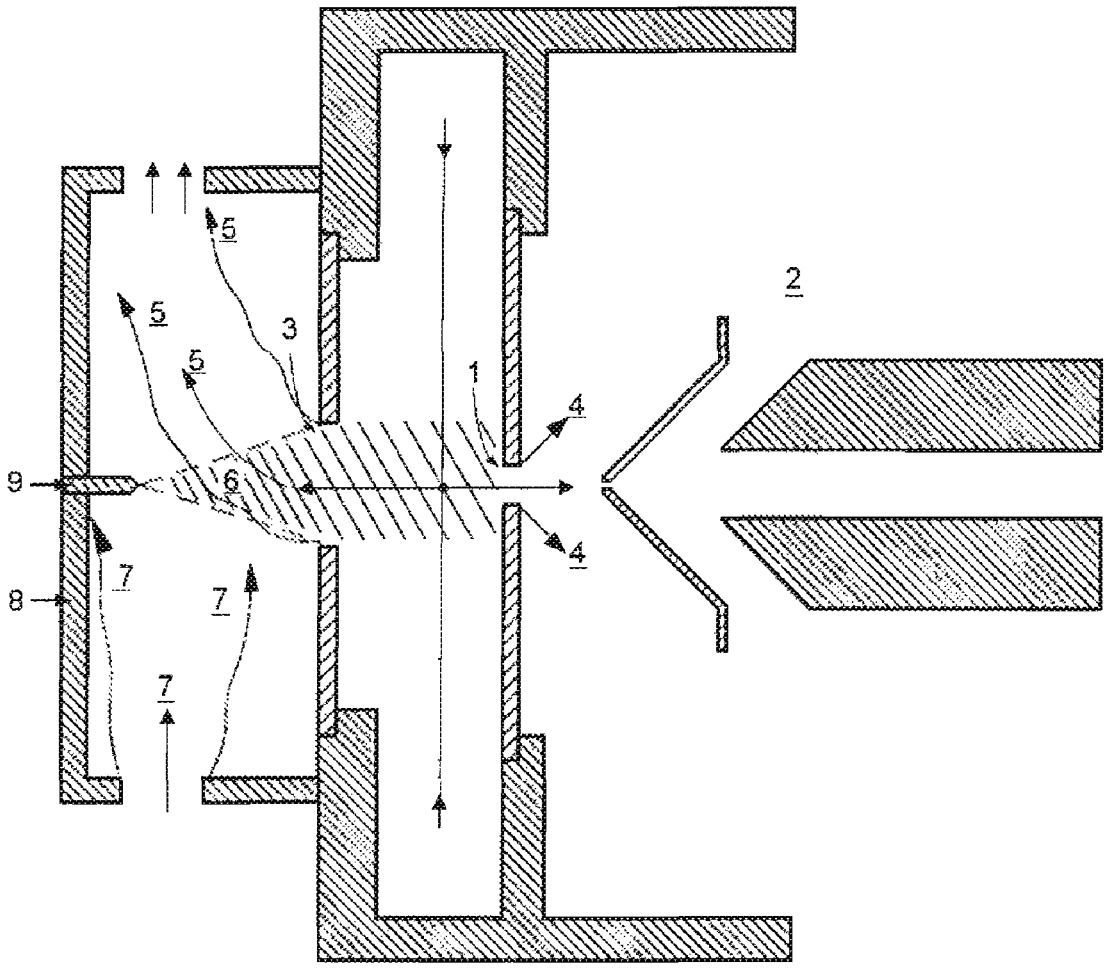
FIG. 2 illustrates schematically some of the elements in the fluid and electric configuration of a vapor ionization chamber of the type proposed in U.S. Ser. No. 11/732,770.
Figure 3:
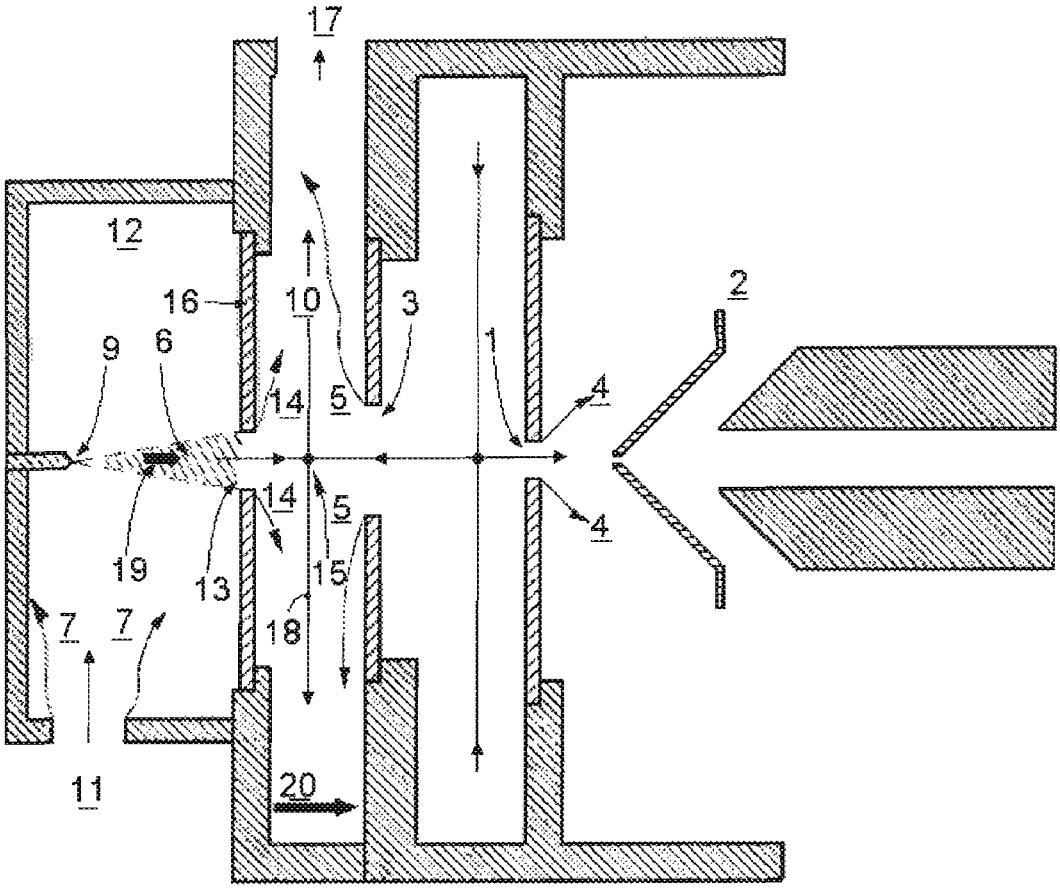
FIG. 3 illustrates schematically the fluid and electric configuration of a vapor ionization chamber with an electrospray charger, where the ionization and the counterflow regions are separated by interposing an intermediate impaction chamber according to the present invention.

The new ionizer isolates the effective ionization volume from the counterflow region by placing them in separate chambers: an ionization chamber and an impaction chamber. Both chambers are communicated through an orifice, to be referred to as the impaction orifice. The impaction orifice is formed in the plate separating both chambers (the impaction plate), and is approximately aligned with the axis of the inlet orifice (1) to the analytical instrument (2), as shown in FIG. 3. The analytical instrument (2) may be, for instance, a mass spectrometer or a differential mobility analyzer. The counterflow jet (5) emerges from the curtain plate orifice (3) and enters the counterflow impaction chamber (10). The sample flow (7) enters first through the sample inlet (11) in the ionization chamber (12), where it gets in contact with the electrospray cloud (6). In the impaction orifice (13), the sample flow is accelerated towards the counterflow impaction chamber (10). The jet formed by the sample flow (14) exiting the ionization chamber through the impaction orifice impacts against the counterflow jet (5), leading to a configuration with a stagnation point (15) in the fluid velocity field. This arrangement minimizes the entry of the counterflow jet (5) into the ionization chamber. This stagnation point will be located at a certain distance from the impaction plate (16) separating the ionization chamber and the impaction chamber, and will tend to be in the impaction chamber downstream from the impaction orifice. The sample gas and the counterflow gas are mixed downstream from this stagnation point and are evacuated from the impaction chamber through the evacuation sink (17). Therefore, the position of the boundary (18) separating the sample flow region (note that the sample flow region is coincident with the ionization region) and the counterflow region is relatively independent on the flow ratio. Note that the fluid dynamic instabilities in the virtual impacting boundary separating the sample flow and the counterflow will tend to arise somewhat downstream from the stagnation region, and will have little effect on the ionization chamber. The ionization source (9) shown in FIG. 3 is located opposed to the impaction orifice in the ionization chamber, but inclined configurations are also useful, particularly when auxiliary electrodes to be later discussed are added. Ionization of vapors in the sample flow (7) takes place in the ionization chamber via contact with charged particles, for instance, an electrospray cloud (6). The electric field of the ionization chamber (19) guides the ionized vapors towards the impaction orifice. Once the ions are in the counterflow impaction chamber, the electric field of the counterflow impaction chamber (20) guides them towards the curtain plate orifice.

The ionization chamber is therefore relatively immune to dilution by turbulent mixing of the counterflow and the sample flow. The main source of dilution affecting the ionization chamber is diffusion of target gas through the impaction orifice, whose importance is determined by the Peclet number Pe=UL/D (U, L and D are the characteristic flow velocity, geometric length, and diffusion coefficient of the target vapor, respectively). This effect is small compared to the convective removal of vapor provided that Pe>1, a condition that can be easily achieved by judicious choice of the parameters U, L and D.

A key point in the operation of this proposed scheme is that the fluid has to be sufficiently stable in the impacting region to avoid convective penetration of counterflow gas into the ionization chamber. Regarding the stability of the configuration, previous studies with virtual impactors at much higher Reynolds numbers than typical in the present application have shown that the configuration herein explained is stable with flow ratios q as low as 1/30. The configuration here proposed is slightly different, as the sample flow is exiting the orifice to impact the counterflow gas. Nevertheless, for simplicity we will assume that stability of both configurations can be achieved under similar conditions. As the Reynolds number in our application can be much lower than those of the virtual impactors, (typically working at high speeds), much lower flow ratios can be reached here.

The electric field in the ionization chamber can be designed to guide the ionized vapors to the exit of this chamber, as will be later discussed. The electric field may be generated by one or more electrodes and/or semiconducting surfaces located in the ionization chamber. The fluid velocity also helps in this task, tough its influence is relatively modest, particularly at low flow ratios.

In the counterflow impaction region, though the fluid velocities tend to sweep everything away from the analyzer inlet, it is easy to produce a strong electric field by applying a voltage difference between the impaction plate and the curtain plate to drive the ions into the analyzer. Consequently, the dilution of ions on their path from the ionizer to the analyzer can be minimized while the counterflow can still sweep contaminating species which are either neutral or have low mobility. The use of substantial electric fields in this region is of special interest when the ionization source is an electrospray (or another unipolar ion source), as space charge tends to dilute the target ions crossing the counterflow impaction chamber. The dilution of both target ions and charger ions as they cross the counterflow region can be evaluated by integrating the equations governing the dynamics of ions under the electric field. Again, the effect of the target ions on the electric field can be neglected as the concentration of target ions is much lower than the concentration of charger ions. Ignoring also diffusion effects, the concentration of charging ions $n_b$ decays from their initial value $n_{0b}$ as:

$$\frac{1}{n_b} = \frac{1}{n_{0b}} + \frac{Z_b \cdot e \cdot \tau}{\varepsilon_0} \tag{9}$$

Where $n_{0b}$ is the initial concentration of charger ions in the defined impaction interface separating the ionization region and the counterflow region, $n_b$ is the concentration of charger ions at the analyzer inlet after crossing the clean counterflow region, $Z_b$ is the mobility of the charger ions, e is the charge of anion, $\in_0$ is the permittivity of the gas. $\tau$ is the time required by the charger ions since they leave the ionization region until they reach the analyzer inlet. If the electric field is approximately constant all along the ion path through the counterflow region, then $\tau$ is equal to the distance l between the defined interface and the analyzer inlet divided by the electrical speed of the ions. The new expression describing the charger ion concentration becomes.

$$\frac{1}{n_b} = \frac{1}{n_{0b}} + \frac{e \cdot l}{\varepsilon_0 \cdot E_{cf}} \Leftrightarrow \frac{n_b}{n_{0b}} = \frac{1}{1 + n_{0b}\frac{e \cdot l}{\varepsilon_0 \cdot E_{cf}}}, \tag{10a, b}$$

where $E_{cf}$ is the electric field in the counterflow region. Neglecting the gas velocity in the impaction region and assuming that the target ions are only driven by the electric velocity, though at a different speed (unless $Z_i=Z_b$), they will follow the same streamlines as the charger ions. As target ions are not created any longer in the clean region, the flux of target ions remains constant along the streamlines, very much as the flux of charging ions. This implies that $n_i/n_{0i}=n_b/n_{0b}$. Therefore the required criterion to assure that dilution of target ions in the counterflow region can be neglected is the same as the criterion for charger ions:

$$\frac{1}{n_{0b}} >> \frac{e \cdot l}{\varepsilon_0 \cdot E_{cf}}. \tag{11}$$

The second term of the inequality can be reduced by decreasing l and increasing $E_{cf}$. The first term of the inequality can also be increased to assure that space charge in the counterflow region can be neglected. The only necessary thing to do in order to reduce $n_{0b}$ is placing the source of charger ions (i.e. the electrospray tip) far enough from the defined interface. As already demonstrated in [13], the concentration of charger ions in the vicinity of the Taylor cone is inversely proportional to the distance to the Taylor cone tip to the 3/2 power. More generally, the concentration of charger ions always decreases as the distance to the source increases due to diffusion and space charge.

The results obtained hold as long as $n_{0b}>>n_i$. The requirement that the concentration of target ions be significantly lower than the concentration of charger ions arises because the effect of the target ions has been neglected in the kinetics of the chemical reactions (1) and on the electric divergence (2b). The theoretical model herein proposed does not explain what happens when the concentration of target ions is comparable to or higher than the concentration of charger ions. However, it is evident that, in the absence of charger ions, ionization cannot take place. Thus there is a limit on to how much one can reduce $n_{0b}$. The combined inequalities (11) and $n_{0b}>>n_i$ become:

$$\frac{1}{n_i} = \frac{1}{n_v} \cdot \frac{Z_i \cdot e}{k \cdot \varepsilon_0} >> \frac{1}{n_{0b}} >> \frac{e \cdot l}{\varepsilon_0 \cdot E_{cf}} \Rightarrow \frac{k \cdot n_v}{Z_i} << \frac{E_{cf}}{l} \tag{12a, b, c, d}$$

In the case of interest involving lowest detection limits for $n_v$ below 1 ppt, this inequality is always satisfied.

Figure 4:
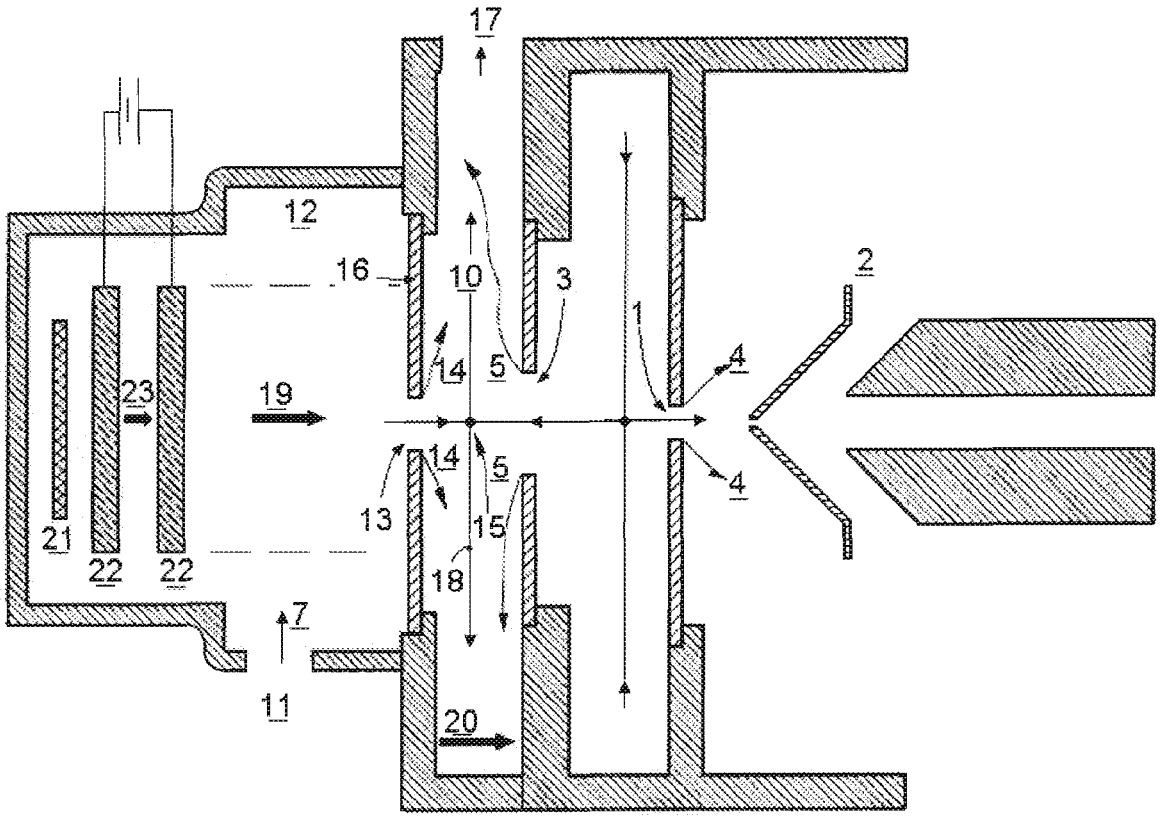
FIG. 4 illustrates schematically the fluid and electric configuration of a vapor ionization chamber based on a radioactive source combined with electric field, including also an intermediate impaction chamber.

The discussion has been so far restricted to conditions where the concentration of charger ions is limited by space charge, where (9) describes well the change of ion concentration from an initial value $n_o$ to a final value n after an elapsed time t. Under conditions given by (12), space charge is presumed to be negligible so that n remains close to $n_o$. Note that (12) is meant for the counterflow impaction region while (5) and (6) are meant for the ionization region. In equation (5), the space charge effect is expressed in terms of $q_1/q_2$ (Note that, if space charge was negligible, then $q_1/q_2$ would be equal to one, while we are assuming that $q_1/q_2<<1$). In (6), space charge is clearly dominating since it is corresponding to a point source of unipolar charge where n is initially much larger than its final value ($n_{ob}>>n_b$). This other limit applies to the charger ions in an electrospray of a highly conducting liquid at low liquid flow rates (or a comparably concentrated source of unipolar ions). The present invention, however, is not restricted to such intense sources, since similar considerations apply to other ion source types, such as those where ionizing radiation (radioactive particles or photons of sufficient energy) produces as many positive as negative ions. These ions may be separated by application of an electric field, and used in certain regions of space as unipolar ion sources, similarly as the electrospray just discussed. In such cases, the restriction $q_1/q_2<<1$ may not necessarily be achieved, leading to the expression for $n_i$ given by (5), where $q_1/q_2$ now depends on the electrical configuration of the ionization chamber. Notwithstanding this, $p_{mi}$ will still be increased by reducing the sample flow rate, and by suitable control of the electric fields, for the same reasons already discussed in the case of electrospray chargers or other unipolar chargers. FIG. 4 illustrates schematically how a unipolar charging region is achieved within the ionization chamber. FIG. 4 is similar in every detail to FIG. 3, except for the use of a different ionization source. The ion source in FIG. 4 relies on a bipolar neutral plasma, where both positive and negative ions are produced. In the embodiment shown in FIG. 4, the bipolar plasma produced is subjected to an electric field. The original neutral plasma is produced by the ionizing radiation from the radioactive source (21). Two meshed electrodes (22) immersed in the ionized region produce the electric field (23) responsible for the separation of ions of different polarities. Accordingly, a substantial fraction of ions of one polarity (positive or negative) may be removed, whereby ions of the opposite polarity not substantially removed are primarily able to contact some vapor molecules turning them into ionized vapors.

The fluid-dynamic separation of the charging and counterflow regions proposed in this invention brings similar advantages in other charger types, since it generally enables lowering the sample flow rate and increasing the residence time of neutral target vapors. This important point may be illustrated by examining a charger radically different from those so far discussed, such as a bipolar ion source including regions where positive and negative charger ions have similar concentrations. In this case, charger ion concentrations are not limited by space charge, but by recombination of ions having opposite polarities. The same recombination limitation applies to ionized sample ions. As a result, when a bipolar ion charger is used, the value $n_i$ achieved in the ionization region will be given by the equilibrium of chemical reactions and will be different from the value calculated under the conditions of (6). The value of p will also be different from that expressed in (7). Nonetheless, equation (8) holds and there is still advantage in avoiding counterflow dilution, and in controlling vapor residence time in the charging region.

In order to facilitate the fluid stability of the impaction region, it is interesting to keep the impaction orifice as small as possible. If the diameter of the counterflow orifice $d_c$ and the resulting diameter of the impaction orifice is $d_{io}$, then the local Reynolds number in the impaction orifice can be reduced by a potentially large factor $(d_{io}/d_c)^2$ with respect to the counterflow Reynolds number defined in terms of the fluid's kinematic viscosity v, the diameter of the counterflow jet $d_c$ and the counterflow jet velocity U as $$Re=d_c U/\nu. \tag{13}$$

The reason is that the characteristic length is reduced by the factor $d_{io}/d_c$, while the flow velocity in this region (stagnation point flow region when there is little or no sample flow) is also reduced by another $d_{io}d_c$ factor. This reduction of the local Reynolds number makes the orifice much more stable in terms of fluid turbulence. By reducing the impaction orifice diameter, the flow ratio can be made even lower for two reasons. (i) The velocity of the sample flow through the impaction orifice can be reduced while maintaining a stable flow configuration because the local Reynolds number is reduced by a factor $(d_{io}/D)^2$. And (ii) the area of the orifice is also reduced by a factor $(d_{io}/D)^2$. Another side effect of reducing the impaction orifice diameter is that the area available for sample vapor diffusion out of the ionization chamber is also reduced by the factor $(d_{io}/D)^2$.

But the impaction orifice should not be made too small. We have argued that, in order to achieve a high single molecule probability of ionization $p_{mi}$ at decreasing sample flow rate, the target ions must be substantially extracted from the ionization chamber by the electric field. For this reason, consideration of the electric fields in the ionization and the impaction chambers is vital to achieve the full benefit of this invention. By strengthening the electric field in the counterflow impaction region and thus in the impaction orifice (when based on a relatively thin plate), it is possible to narrow the effective ionization volume as it crosses the impaction orifice.

In the counterflow impaction region, the flux of the electric plus the fluid velocities times the concentration of ions through any section of the effective ionization volume remains constant and equal to the flow ingested by the analyzer, as long as diffusion and space charge effects are small enough to be neglected. This can be assumed as long as inequality (12b) is satisfied (more precise calculations can also be carried to include diffusion and space charge effects). It is then easy to estimate the diameter $d_{iv}$ of the effective ionization volume as is crosses the impaction orifice. For instance, for a typical mass spectrometer sampling 0.5 litters per minute and assuming an electrical velocity of 100 m/s, $d_{iv}$ would be 0.5 mm. Assuming that $d_{io}$ could be made as small as $d_{iv}$, that the counterflow orifice diameter is 3 mm and that the velocity ratio between counterflow and sample flow can be 1/30, then the flow ratio can be as low as 1/1000.

Figure 5:
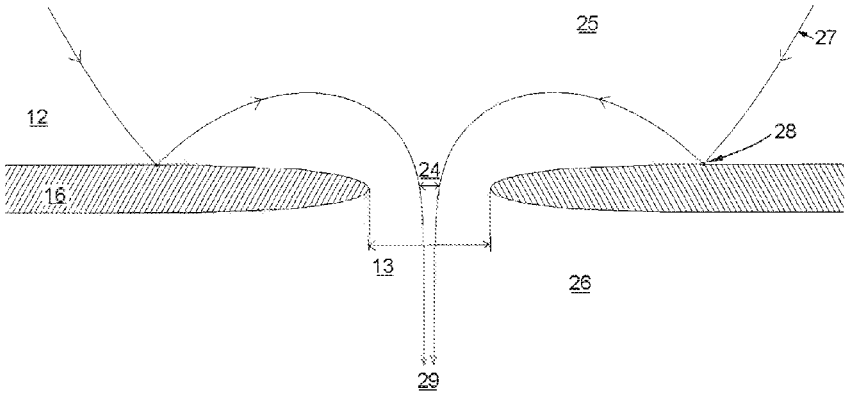
FIG. 5 illustrates the electric field configuration of a simple impaction orifice.

Referring then to FIG. 5, the diameter of the impaction orifice (13) can be made almost as small as the local diameter of the effective ionization volume (24). However, a careful design of the electrical configuration in the ionization chamber is also required here to ensure that all the streamlines of the effective volume of ionization cross the impaction orifice and reach the ionization source and are thus filled with ions. Note that the result expressed in equation (6) is only valid for those streamlines filled with charger ions. If the streamline is born from a simple electrode, then said streamline will not carry any ion and, thus, it will not serve our charging purposes. If the electric field strength in the vicinity of the impaction orifice (13) is lower in the upstream side (25) (i.e., inside the ionization chamber (12)) of the impaction orifice (13) than in the downstream side (26) (i.e., inside the impaction chamber (10)) in proximity to the impaction orifice (13), then the configuration of the streamlines (27) will exhibit an annular stagnation line (28) around the impaction orifice as shown in FIG. 5. In this figure, the relation between the section area of the impaction orifice (13) and the section area downstream the orifice of the stream tube born in the annular stagnation line grows with the ratio of the electric strength downstream and upstream the flow. The ion-filled stream tube (29) is much smaller than the orifice diameter. In this case, to ensure that all the effective ionization volume is filled with ions coming from the ionization source, either the impaction orifice (13) would have to be bigger than the local diameter of the effective ionization volume (24), and/or the electric field strength in the region upstream (25) the impaction orifice would have to be as high as it is downstream (26) the impaction orifice.

With this kind of configuration it becomes important to achieve a precise centering of the parts defining the ion filled stream tube and the effective ionization volume to assure that every streamline introduced in the analyzer is filled with ions.

Figure 6:
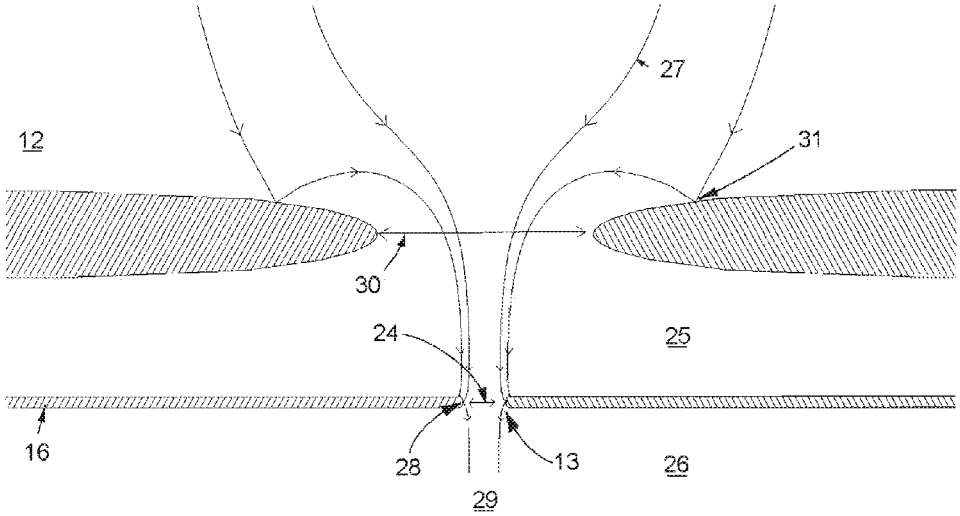
FIG. 6 illustrates the electric field configuration of an impaction orifice incorporating an auxiliary transition electrode.

By means of a correct design of the electric configuration of the ionization chamber, it is possible to reduce the required diameter of the impaction orifice (13) if one wishes to maintain a less intense electric field in the ionization region. FIG. 6 illustrates the detail of the improved electric configuration. The impaction orifice has a different potential than the rest of the ionization chamber (12). Between the impaction orifice (13) and the bottom orifice (30) of the ionization chamber (termed from now on the electric transition orifice) the voltage is chosen so that the electric strength upstream (25) (i.e., inside the ionization chamber (12)) in proximity to, and downstream (26) (i.e., inside the impaction chamber (10)) in proximity to, the impaction orifice are similar (i.e., equal or substantially equal). The annular stagnation line (28) is brought to the edge of the impaction orifice (13) and the local thickness of the impaction plate (16) is made smaller than the orifice diameter itself. The region affected by the annular stagnation line (28) is minimized and the impaction orifice diameter can thus be as small as the local diameter of the effective ionization volume (24). The change in the electric field strength takes place through the electric transition orifice (30). Another annular stagnation line (31) is formed upstream this orifice (30). The electric transition orifice (30) has to be wide enough to accommodate the streamlines (27) crossing the impaction orifice (13) and also those streamlines born between the stagnation line (31) and the edge of the transition orifice. This configuration can also be used with wider impaction orifices to avoid the requirement of precise alignment. In this way, the ion-filled stream-tube (29) reaches a diameter as large as the impaction orifice, which can then be kept small to prevent fluid instabilities.

The electric transition orifice described here offers certain useful advantages. However, this invention is not restricted to this electrode geometry, but includes other arrangements serving the purpose of strengthening the electric field within the charger such that a sufficient number of electric field lines carrying charger ions are drawn into the analyzer. One possible configuration among many others would place an additional electrode further upstream, for instance near the plane where the point source is located, or even further upstream. Another configuration would rely on more than one electric transition orifices placed in series. Still another would use semi-conducting surfaces to create desired axial field distributions in a vein similar to those used as ion mirrors in time of flight mass spectrometers.

The ionization chamber can also be heated with, for instance, an electric resistance, in order to use it to analyze species that would be insufficiently volatile at room temperature, for instance, in cases when explosive vapors are thermally desorbed from a filter or a collector. The sample gas can also be heated before being introduced in the ionization chamber. Many IMS systems used for explosive analysis do in fact heat the whole analyzer. We note, however, that heating the analyzer is not essential in analyzers using counterflow gas, since potentially condensable volatiles are excluded from the analyzer by the counterflow gas. Since many analyzers are not designed to work with vapors of low volatility, they often cannot tolerate the heating levels sometimes necessary to avoid vapor condensation. Therefore, if one wants to heat all the parts in which vapors could be condensed while keeping the analyzer at a limited temperature, one must limit the heat flux from the heated ionization chamber into the analyzer. In such cases, the charger and impaction chambers may be substantially heated without the need to heat the analyzer unduly. In the case of analyzers using a curtain plate, conductive heat flux from the ionization chamber to the analyzer can be easily limited as the curtain plate and the impaction plate are separated by a dielectric material that can be chosen to be a good thermal insulator. Convective heat flux from the ionization chamber to the analyzer can also be limited when the heated sample flow is impacted with a colder counterflow. This is true in particular when the flow ratio is drastically reduced, since the temperature of the impaction chamber will then be dominated by the temperature of the counterflow gas.

In the case of analyzers not using a curtain plate, such as the DMA of U.S. Ser. No. 11/786/688, the counterflow gas emerges from the ion entrance slit in the inlet electrode. In order to avoid thermal fluid instabilities in the DMA sheath flow, it is important to limit the thermal gradient in the DMA channel formed between the two electrodes, for instance, by confining most of the thermal gradient to the impaction chamber. For those cases when heating is desired, it may be preferable to use ionization sources capable of working under high temperature, such as the charger shown in FIG. 4. From the point of view of maximizing the stability of the impaction region against thermal convection at low sample flow rates, whenever possible, it is preferable to align vertically the axis of the sample flow and to introduce the heated sample flow from above.

Figure 7:
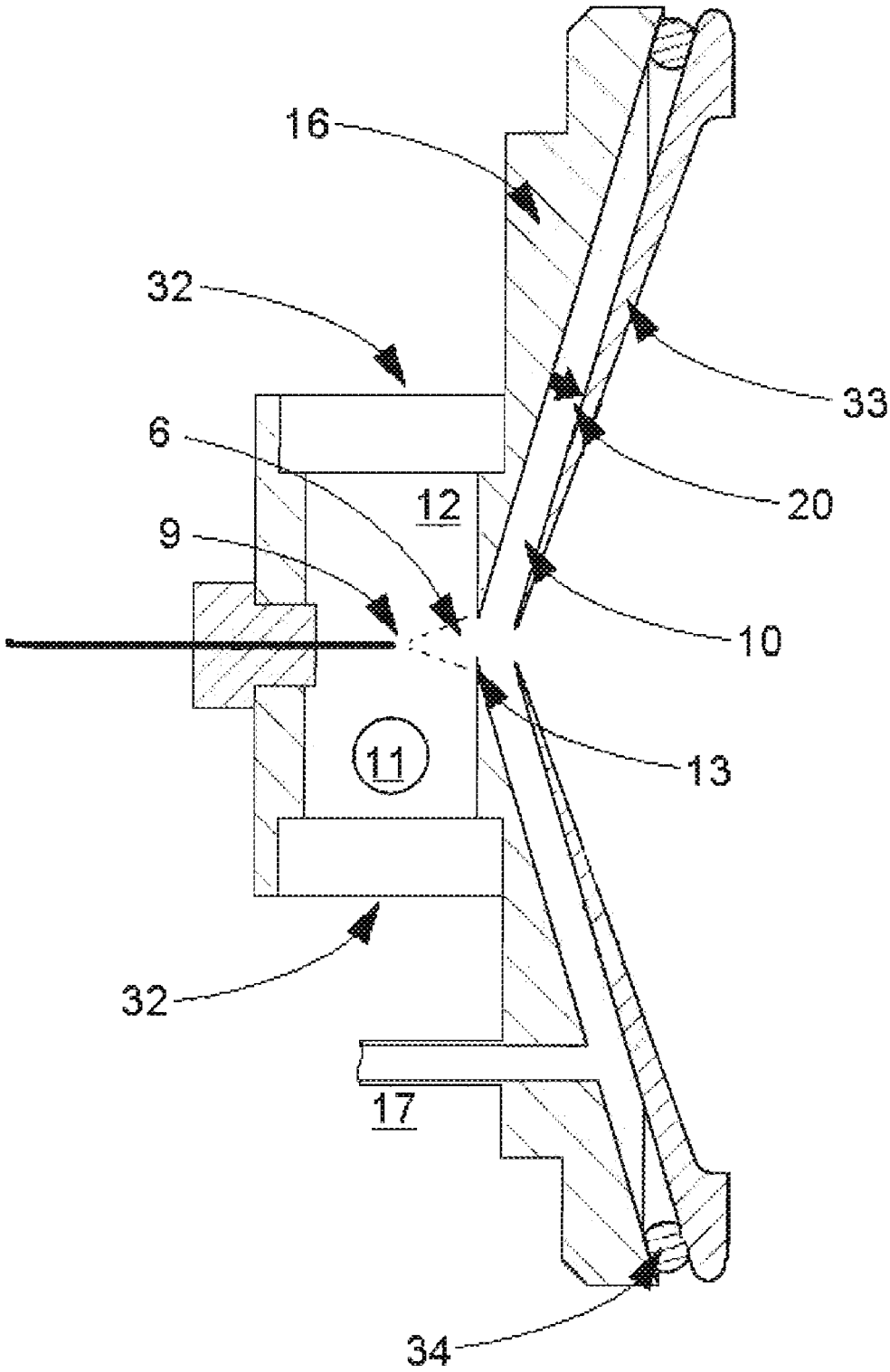
FIG. 7 illustrates one preferred embodiment of the present invention developed for an API 5000 MS analyzer comprising an electrospray ionization source and a simple impaction orifice configuration of the type shown in FIG. 5.

The coupled ionization chamber and counterflow impaction chamber already described can be used in a variety of ways according to the present invention. One embodiment of the invention is shown in FIG. 7. The analyzer is Sciex's API-5000 Mass Spectrometer, though other mass spectrometers with an atmospheric pressure source, or other ion analyzers could be similarly used, including among others ion mobility spectrometers (IMS) or differential mobility analyzers (DMAs). The ionization source (9) is in this case the Taylor cone of an electrospray. Vapor species are ionized by bringing the sample gas into close contact with the electrospray cloud (6). Note that the vapors may be ionized by contact with either the charged drops or the ions produced by their evaporation. Although electrospray charging has some special advantages, other sources of charge can be similarly used to ionize the vapors. Well known examples of unipolar and bipolar ionization sources include radioactive materials, corona discharges, and other sources of ionizing radiation (UV light, X rays, etc.). In the embodiment shown in FIG. 7 there are two windows (32) in the ionization chamber (12) to facilitate visualization of the Taylor cone (9). The sample flow enters in the ionization chamber (12) through a tube (11). The ionization chamber communicates with the counterflow impaction chamber (10) though the impaction orifice (12). In this case, the simple configuration of FIG. 5 without the auxiliary electrode of FIG. 6 is depicted. The counterflow impaction chamber (9) is made by the cavity formed between the MS curtain plate (33) and the impaction plate (16) partially closing from below the ionization and impaction chamber. Insulators (34) are used to seal the counterflow impaction chamber (10) and to allow application of different electrical potentials and thus produce the electric field (20) required to push the ions into the analyzer. The sample and counterflow gases are evacuated though a tube (17).

Additional electrodes such as the one depicted in FIG. 6 can also be incorporated in the ionization chamber to better control the movement of the ions within the chamber and through the impaction orifice (or the impaction slit).

Though the preferred embodiment is axisymmetric and the impacting jets have circular sections, if the inlet of the analyzer requires more complex geometries, the configuration of the present invention can also be implemented with more complex geometries. For instance, in two-dimensional or annular configurations, the impaction orifice has to be replaced by an impaction slit fining the inlet slit of the analyzer.

Figure 8:
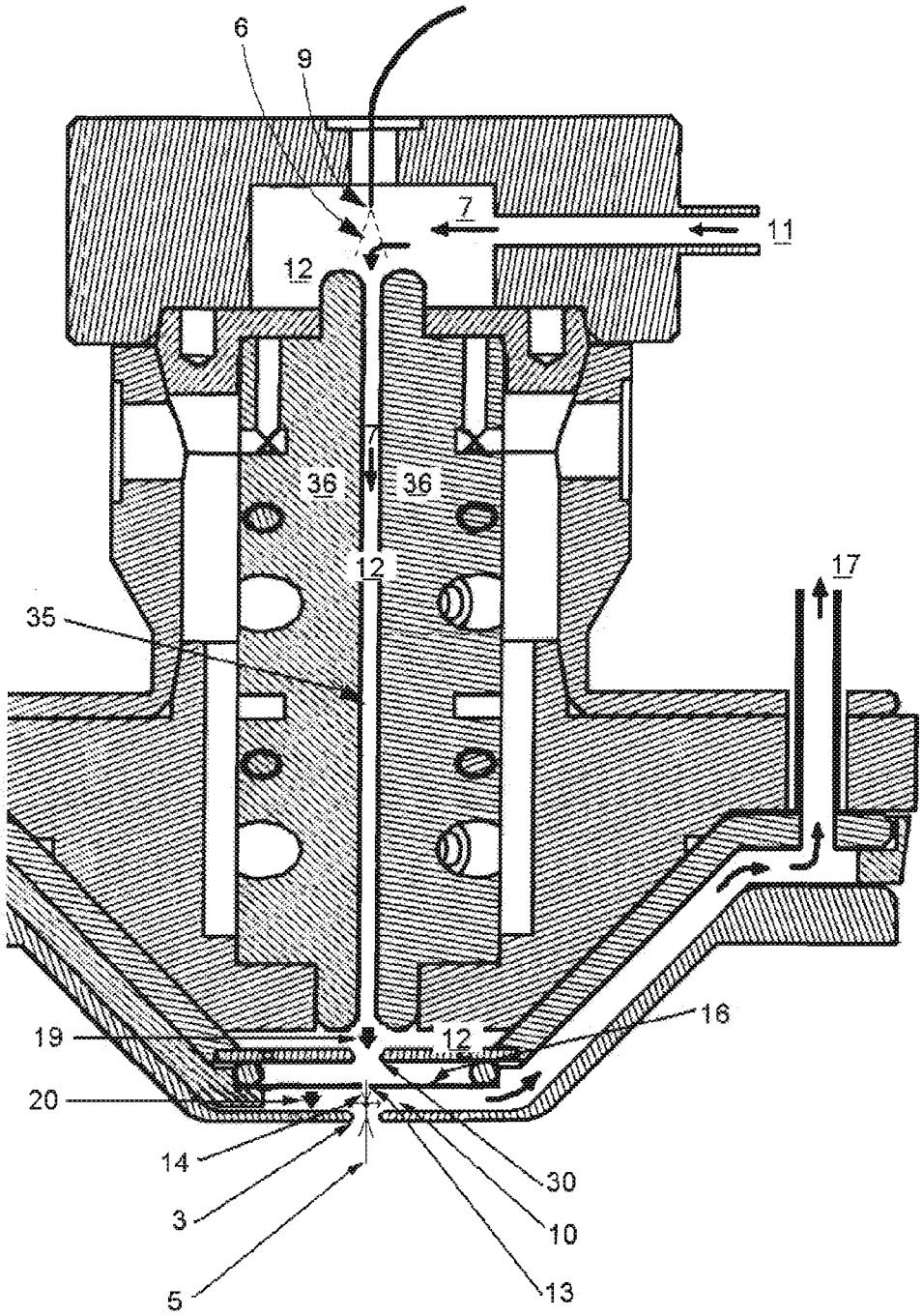
FIG. 8 illustrates one preferred embodiment of the present invention developed for a Q-Star MS analyzer comprising an electrospray ionization source, the cuadrupole charger of PCT/EP2008/053960, and an impaction orifice configuration with transition electrode of the type shown in FIG. 6.

The impaction chamber of the present invention can also be used in conjunction with other charging devices and analyzers. For instance, FIG. 8 illustrates the coupling of the present impaction chamber to a Q-Star MS manufactured by Sciex. The ionization chamber in this case comprises the quadrupole charger of PCT/EP2008/053960, in which the intense alternating electric fields achieved inside the quadrupole permit unusually high concentrations of charger ions over unusually large volumes by confining them radially against space charge. The impaction orifice configuration selected is the more complex one of FIG. 6. In the embodiment of FIG. 8, the counterflow jet (5) emerges from the curtain plate orifice (3) and enters the counterflow impaction chamber (10). The sample flow (7) enters first through the sample inlet (11) in the ionization chamber (12). After crossing the quadrupole channel (35) and the transition orifice (30), the sample flow is accelerated in the impaction orifice (13) towards the counterflow impaction chamber (10). Both the sample jet (14) and the counterflow jet (5) impact in the counterflow impaction chamber. The counterflow and the sample flow are mixed downstream the impaction orifice (13) and are then evacuated from the counterflow impaction chamber (10) through the evacuation sink (17). The ionization source (9) and the axis of the quadrupole are aligned with the impaction orifice (13) and the transition orifice (30) in the ionization chamber (12). Ionization of vapors takes place in the ionization chamber (12). The sample flow (7) transports axially the ions through the quadrupole channel (35) formed between the RF poles (36) The RF field increases the charger ion concentration while the neutral target vapors concentration is kept undiluted. The electric field of the ionization chamber (19) and the transition electrode (30) guides the formed ions towards the impaction orifice (13). Once the ions are in the counterflow impaction chamber, the electric field of the counterflow impaction chamber (20) guides them towards the curtain gas orifice.

The ionization chamber can be heated to limit adsorption of the least volatile species. The sample gas can also be conducted through a heated line. The sample gas can be obtained from a preconcentration device such as a desorbed filter or an online particle concentration device based on inertia, such as that explained in U.S. Provisional Patent Application 61/131,878.

Figure 9:
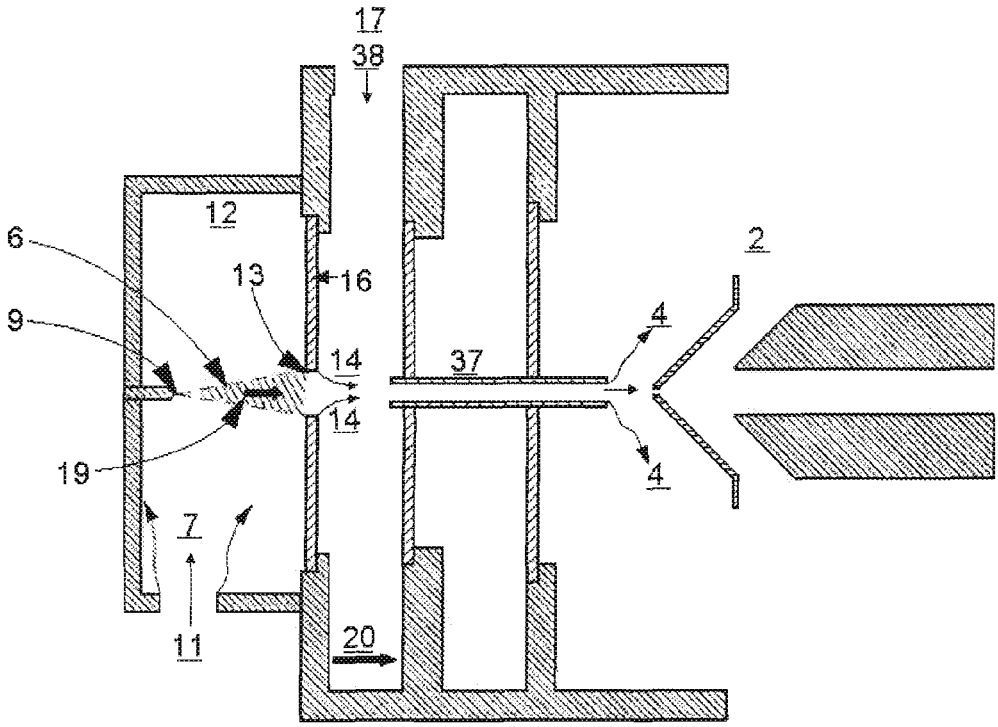
FIG. 9 illustrates a situation without counterflow gas, where an impaction plate increases the effectiveness of the charger by allowing use of a smaller flow rate through the ionization chamber than through the analyzer.

Another embodiment of the present invention is similarly useful in the absence of counterflow gas, as shown schematically in FIG. 9. Equation (8) evidently also applies in this case, so that reducing $Q_S$ can highly increase $p_{mi}$. As the ionization region is decoupled in terms of the fluid configuration from the rest of the system, it is possible to feed the ionization chamber with the required small sample flow, and introduce the rest of the flow drawn by the analyzer through a secondary inlet (37) which can be, for instance, the entry port (17) used in the prior embodiments of this invention for the opposite purpose of evacuating the counterflow and sample gases after they are impacted in the impaction chamber. The embodiment shown in FIG. 9 is typical of mass spectrometers using no counterflow gas, where the inlet orifice is a heated capillary (38), though other alternative inlet configurations for the analyzer exist, and are also considered part of the present invention. Note that the mode of operation with $Q_S<Q_A$ is even more counterintuitive in a situation without counterflow than in one with counterflow, as it is commonly assumed that a higher sample flow rate yields a larger signal. But this assumption is evidently incorrect when the sample available is limited. The benefit sought of a more efficient use of the sample would not be obtained without implementing the two key elements of the present invention. First, the ionization chamber has to be protected from the substantial balance flow $Q_A-Q_S$ of clean gas that must be fed to the analyzer through the secondary inlet (37), which could disrupt the operation of the charging chamber (similarly as the prior counterflow gas, even though the direction of the clean is now inverted). This problem can be avoided easily by means of the impaction plate (16) which acts now as a separating plate similarly as when it protects the ionization chamber in analyzers comprising counterflow gas. Similarly, it would normally not be possible to fill with target ions the majority of the streamlines sampled into the analyzer without an impaction orifice (13) and an electric field carefully designed according to the present invention. Paradoxically, although a substantial fraction of the gas drawn into the analyzer is clean gas entering through the secondary inlet (37), the flux of target ions sampled may still be $Q_A n_i$, so that the full suction capacity of the analyzer is utilized without necessarily wasting the limited stock available of sample. Preferably, the ratio $Q_A/Q_S$ is less than ½.

The present invention can also be used as the more commonly used electrospray source introduced in U.S. Pat. No. 4,531,056, where the sample ionized is originally dissolved rather than in the gas phase. The electrospray needle would ideally be introduced through the impaction orifice and the Taylor cone would be formed directly in the counterflow impaction region. The main advantage of this feature is that the user will not need to switch from one chamber to another when in need to make analysis both in the gas phase and in the liquid phase. The strong electric field produced in the impaction chamber will reduce the time of residence of the ion cloud before entering the analyzer and, thus, the sample of ions ingested by the analyzer will be less diluted than it would be without said electric field.

The electric configuration of the impaction orifice can be as simple as in FIG. 5, or more complex as in FIG. 6, depending on the requirements of flow ratio. If the flow ratio achieved with the configuration of FIG. 5 is sufficient, then this configuration is preferable due to its greater simplicity. For those applications requiring even higher flow ratios, then the configuration shown in FIG. 6 is preferable.

The present invention is especially useful when the original sample is limited and low sample flows are desirable, for instance to avoid dilution of the sample vapor by the carrier gas. It can be used for explosives detection. It can also be used in medical applications such as the analysis of the skin vapors or the analysis of breath. Their monitoring in breath would be in many cases of great interest, particularly because it can take place in humans, non-invasively, in real time, and for relatively long periods. Real time API-MS analysis of human skin vapors and breath was introduced by Martinez-Lozano and J. Fernandez de la Mora. But, though they obtained lower detection limits in the range of ppts (parts pert trillion), the high sample flow rates required by their configuration diluted the measured sample. The new scheme here proposed can improve the concentration of the sample and the sensitivity of the system. New species at lower concentrations are likely to be found with the same or even higher sensitivity, providing a richer fingerprint for the volatiles produced by breath, skin, etc.

What is claimed:

1. A method to ionize vapors carried in a sample gas for analysis in an analytical instrument, the method comprising:

providing an apparatus having an ionization chamber and an adjacent impaction chamber separated by an impaction plate having an impaction orifice defined therein;

introducing said sample gas at a flow rate $Q_S$ into said ionization chamber including a source of charged particles, such that some among said vapors in said sample gas make contact with said charged particles to become ionized vapors;

introducing clean gas into said impaction chamber; and, providing one or more electric fields such that some among said ionized vapors are guided through said impaction orifice, through said clean gas in said impaction chamber, and into an analytical instrument possessing an inlet orifice sampling an inlet flow rate $Q_A$, wherein, said impaction orifice is configured such that said sample gas passes through said impaction orifice to define a jet therethrough extending into said impaction chamber, said jet minimizing the passage of said clean gas through said impaction orifice from said impaction chamber and into said ionization chamber, and wherein, said jet of sample gas collides against a jet of counterflow gas originating in said analytical instrument, both jets colliding in the impaction chamber such that penetration of said jet of counterflow gas into said ionization chamber is minimized.

2. The method of claim 1 where the ratio $Q_S/Q_A$ between said two flow rates is less than ½.

3. The method of claim 1 where said ionization chamber includes one or more auxiliary electrodes or semiconducting surfaces to facilitate said guiding of said ionized vapors.

4. The method of claim 1 where said source of charged particles is an electrospray.

5. The method of claim 1 where said source of charged particles produces both positive and negative ions.

6. The method of claim 5 including means to remove a fraction of ions of one polarity among said positive and negative ions, such that the ions of the opposite polarity not removed are primarily able to contact some among said vapors turning them into said ionized vapors.

7. The method of claim 1 where said analytical instrument is a mass spectrometer.

8. The method of claim 1 where said analytical instrument is a differential mobility analyzer.

9. An apparatus to ionize neutral vapors carried in a sample gas for analysis, comprising:

an ionization chamber including: a source of charged particles, an inlet to introduce said sample gas carrying said neutral vapors into said ionization chamber, and an impaction orifice, wherein said ionization chamber is configured to permit contact between said charged particles and said neutral vapors to create ionized vapors;

an impaction chamber, said impaction chamber communicating through said impaction orifice with said ionization chamber, and also including a second orifice; and, means for generating electric fields so as to guide said ionized vapors formed in said ionization chamber through said impaction orifice, impaction chamber, and second orifice, wherein, said sample gas passes through said impaction orifice so as to form a jet that penetrates into said impaction chamber, and, wherein, said jet of sample gas collides against a jet of counterflow gas originating in an analytical instrument and penetrating in said impaction chamber, both jets colliding in said impaction chamber such that penetration of said jet of counterflow gas into said ionization chamber is minimized.

10. The apparatus of claim 9 where said source of charged particles produces a cloud of charged drops.

11. The apparatus of claim 9 where said source of charged particles is one among the following types: a radioactive source, a corona discharge, and a source of photons with sufficient energies to produce ions.

12. The apparatus of claim 9 where said means for generating electric fields includes one or more electrodes or semiconducting surfaces.

13. An assembly comprising:

an apparatus formed in accordance with claim 9; and, an analytical instrument having an inlet orifice in communication with said second orifice.

14. The assembly of claim 13 where said analytical instrument is a mass spectrometer.

15. The assembly of claim 13 where said analytical instrument is a differential mobility analyzer.

16. The assembly of claim 13 where the flow rate $Q_S$ of said sample gas into said ionization chamber is less than an inlet flow rate $Q_A$ sampled by said inlet orifice of said analytical instrument.

17. The assembly of claim 13 where the ratio $Q_S/Q_A$ between said two flow rates is less than ½.

* * * * *